US010525317B2

(12) United States Patent
Esch

(10) Patent No.: US 10,525,317 B2
(45) Date of Patent: Jan. 7, 2020

(54) MULTI-TARGET BALL TOSS GAME AND METHOD OF PLAYING

(71) Applicant: Brett Esch, North Tonawanda, NY (US)

(72) Inventor: Brett Esch, North Tonawanda, NY (US)

( * ) Notice: Subject to any disclaimer, the term of this patent is extended or adjusted under 35 U.S.C. 154(b) by 0 days.

(21) Appl. No.: 16/124,795

(22) Filed: Sep. 7, 2018

(65) Prior Publication Data

US 2019/0070473 A1 Mar. 7, 2019

Related U.S. Application Data

(60) Provisional application No. 62/555,345, filed on Sep. 7, 2017.

(51) Int. Cl.

| | |
|---|---|
| ***A63B 63/00*** | (2006.01) |
| ***A63B 63/08*** | (2006.01) |
| ***A63B 67/06*** | (2006.01) |
| *A63B 63/06* | (2006.01) |

(52) U.S. Cl.

CPC ..... *A63B 63/08* (2013.01); *A63B 67/06* (2013.01); *A63B 63/00* (2013.01); *A63B 2063/065* (2013.01); *A63B 2210/50* (2013.01)

(58) Field of Classification Search

CPC ..... A63B 67/06; A63B 63/00
USPC ..... 273/398–402
See application file for complete search history.

(56) References Cited

U.S. PATENT DOCUMENTS

| | | | | | |
|---|---|---|---|---|---|
| 922,717 | A | * | 5/1909 | Parker | A63B 67/06 273/401 |
| 2,520,460 | A | * | 8/1950 | Ford | A63B 65/12 124/7 |
| 3,100,642 | A | * | 8/1963 | Goldstein | A63F 3/00895 206/459.5 |
| 3,165,317 | A | * | 1/1965 | Kirsch | A63F 9/0204 273/388 |
| 3,990,703 | A | * | 11/1976 | Evans | A63B 67/06 273/400 |
| 4,012,042 | A | * | 3/1977 | Blasingame | A63B 63/08 273/401 |
| 4,022,472 | A | * | 5/1977 | Seals | A63F 9/0204 273/400 |
| 4,186,925 | A | | 2/1980 | Goldfarb et al. | |
| 4,323,250 | A | * | 4/1982 | Lansberry | A63F 7/305 206/315.1 |

(Continued)

*Primary Examiner* — Mark S Graham
(74) *Attorney, Agent, or Firm* — Vincent G. LoTempio; Kloss, Stenger & LoTempio; David T. Stephenson

(57) ABSTRACT

A multi-target ball toss game and method of playing is played by players on opposing teams standing behind their respective elongated boxes. The boxes are subdivided into a number of discrete target areas. Each target area has a lid that covers and uncovers the target, depending on whether the ball hits the target area. In play, the players take turns tossing balls towards the opposing targets. If the balls fall into the target area, the corresponding lid is closed over the target area. The winning player or team of players is the first player or team that closes all of the lids over the intended targets. The game provides an overtime feature in which both front lids are opened for overtime, and if double overtime both second lids are opened, and if third overtime, third lids are opened, and so forth.

15 Claims, 4 Drawing Sheets

(56) References Cited

U.S. PATENT DOCUMENTS

| | | | | | |
|---|---|---|---|---|---|
| 4,326,722 | A * | 4/1982 | Dickens | A63F 9/0204 | 273/400 |
| 4,826,177 | A * | 5/1989 | Ponte | A63B 43/002 | 273/400 |
| 4,863,176 | A | 9/1989 | Lapkewych | | |
| 4,936,590 | A * | 6/1990 | Palmer | A63B 63/08 | 273/285 |
| 4,938,485 | A * | 7/1990 | Hockridge | A63F 9/02 | 273/354 |
| 4,943,065 | A | 7/1990 | DeLapa | | |
| 4,986,549 | A | 1/1991 | Kuhtic et al. | | |
| 5,342,057 | A * | 8/1994 | Sorkoram | A63F 9/001 | 273/239 |
| 5,595,387 | A | 1/1997 | Senna | | |
| 6,755,711 | B2 * | 6/2004 | McClung | A63B 67/00 | 273/398 |
| 2008/0116644 | A1 * | 5/2008 | Knoernschild | A63B 67/06 | 273/336 |
| 2008/0237990 | A1 * | 10/2008 | Litz | A63B 67/06 | 273/400 |
| 2015/0069708 | A1 * | 3/2015 | Mashburn | A63B 67/06 | 273/400 |
| 2015/0115532 | A1 * | 4/2015 | Martinson | A63B 67/06 | 273/400 |

* cited by examiner

MULTI-TARGET BALL TOSS GAME AND METHOD OF PLAYING

CROSS REFERENCE OF RELATED APPLICATIONS

This application claims the benefits of U.S. provisional application No. 62/555,345 filed Sep. 7, 2017 and entitled "MULTI-TARGET BALL TOSS GAME AND METHOD OF PLAYING," which provisional application is incorporated by reference herein in its entirety.

FIELD OF THE INVENTION

The present invention relates generally to a multi-target ball toss game and method of playing. More so, the multi-target ball toss game is played by players on opposing teams standing behind respective elongated boxes that are subdivided into multiple discrete target areas (holes), with each target area having a lid that covers and uncovers the target, depending on whether the ball hits the target area; whereby players take turns tossing balls towards the opposing targets; whereby if the balls fall into the target area, the corresponding lid is closed over the target area; and whereby the winning player or team of players is the first player or team that closes all of the lids over the intended targets.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

In general, object tossing games require some space and are generally best suited for outdoor activity rather than in the living room. These types of games are known using various types of missiles, such as balls, bean bags, Frisbees, horse shoes, or bolas. Such tossing games test the skill of each player to aim, throw or roll, and properly land rings, balls, or other objects in relationship to each other or to other objects or surroundings. Examples of such games include lawn bowling, horseshoes, bocce ball, and croquet. Though each of these games provide entertainment, each requires either a large amount of playing space which must usually be outdoors, a playing area of a particular nature, or several game pieces which are often cumbersome or inconvenient to carry.

The problem with these is that they do not involve an elongated horizontal box having multiple targets (holes) and corresponding lids that cover and uncover the target. Also, they cannot be played both indoors and outdoors. Even though the above cited ball tossing games meet some of the needs of the market, a ball toss game that can be played indoors or outdoors, and that requires an elongated horizontal box having multiple targets (holes) and corresponding lids that cover and uncover the target is still desired.

SUMMARY OF THE INVENTION

Illustrative embodiments of the disclosure are generally directed to a multi-target ball toss game and method of playing. The multi-target ball toss game involves an elongated horizontal box having multiple targets (holes) and corresponding lids that cover and uncover the target. Players attempt to toss balls into the target from two or more opposing, spaced-apart boxes. As the balls fall into the target the lid(s) is closed over its corresponding target. The winner is the first player that closes all of the lids over their targets.

In some embodiments, the method for playing the ball toss game comprises an initial Step of positioning multiple elongated boxes in an opposing, spaced-apart relationship, the boxes subdivided into a number of discrete target areas, each target area having a lid that selectively opens and closes, opening all of the lids for the target areas, positioning at least one player proximal to each box, providing multiple balls to each player, tossing a ball towards the target area of an opposing box. If the ball engages the target area, the lid on the engaged target area closes. Players can win the game by engaging the balls into all the target areas in the opposing box. The non-winning player continues tossing the balls towards the opposing target areas until all the lids are closed.

A Step may include two or more players.

Another Step may include the boxes being positioned 14 feet apart.

Another Step may include the boxes comprising a length of about 48"; a width of about 13"; and a height of about 6¾".

Another Step may include the target area comprising four 10" holes.

Another Step may include the ball being a 4¼" to 5" sphere.

Another Step may include the lid hingedly connected to the box.

In another embodiment, the multi-target ball toss game includes two boxes and the players standing at opposite ends of their respective box. The players take turns tossing the ball into the opposite box, attempting to put the ball in the target. As the target is struck by the ball, the corresponding lid closes over the target. The first player who closes out the box wins. Boxes are set up 14' apart from each other from both fronts.

In yet another embodiment, the multi-target ball toss game includes 4 boards, 2 teams of 2 players, with teammates standing across from each other at the other board. The objective of each team is to close out both boards before the other team does in relay style form. The first team to close out both boxes wins. If the team closes out the box first, the players from the losing team must throw the ball back to each other until they close out the box as well.

One objective of the present invention is to provide entertainment and develop aiming and throwing skills by allowing players to toss balls at target areas in a number of discrete target areas with the goal of hitting the target areas first.

Another objective is to crown a winner based on the first to close out the target areas 104 with the lids by hitting the target areas first.

Another objective is to provide an overtime option to the game, if necessary.

Another objective is to play the game indoors or outdoors.

Another objective is to not require many moving parts and equipment.

Another objective is to not cause damage to the surface on which the game is played.

Another objective is to allow players of all ages to compete in the ball tossing game.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

Figure 1:
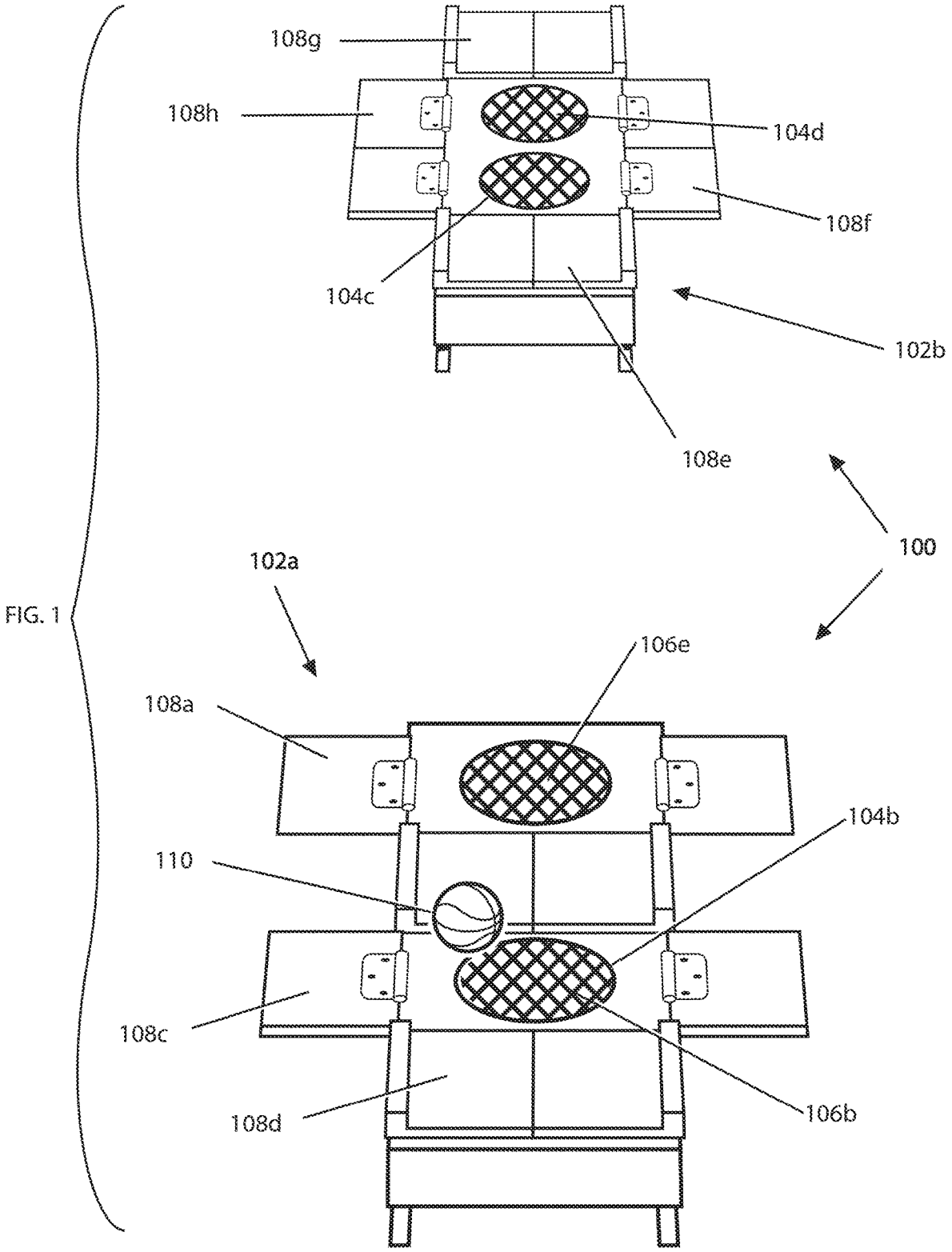
FIG. 1 illustrates a perspective view of an exemplary multi-target ball toss game, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this invention as required by 35 U.S.C. § 112.

In one embodiment of the present invention presented in FIGS. 1-4, a multi-target ball toss game 100 and method 200 of playing provides entertainment and develops aiming and throwing skills by allowing players to toss balls at target areas 104*a-h* in a number of discrete target areas 104*a-h* (holes) with the goal of hitting the target areas 104*a-h* first. Ball toss game 100 is played by players on opposing teams standing behind respective elongated boxes 102*a*, 102*b*. Boxes 102*a*, 102*b* are subdivided into multiple discrete target areas 104*a-h*. Each target area 104*a-h* has a lid 108*a-h* that covers and uncovers a corresponding target area 104*a-h*, depending on whether the ball 110 hits the target area 104*a-h*. In play, the players take turns tossing balls 110 towards the opposing target areas 104*a-h*. If the balls 110 fall into the target area 104*a-h*, the corresponding lid 108*a-h* is closed over the target area. The winning player or team of players is the first player or team that closes all of the lids 108*a-h* over the intended target areas 104*a-h*.

In one aspect of the present invention, a method 200 for playing a multi-target ball toss game 100, comprises:

positioning multiple elongated boxes 102*a*, 102*b* in an opposing, spaced-apart relationship, the boxes 102*a*, 102*b* subdivided into a number of discrete target areas 104*a-h*, each target area 104*a-h* having a lid 108*a-h* that selectively opens and closes;

opening all of the lids 108*a-h* for the target areas 104*a-h;* positioning at least one player proximal to each box 102*a*, 102*b;* providing multiple balls 110 to each player;

tossing a ball 110 towards the target area of an opposing box 102*a*, 102*b;* if the ball engages the target area 104*a-h*, closing the lid 108*a-h* on the engaged target area 104*a-h;* winning the game by engaging the balls 110 into all the target areas 104*a-h* in the opposing box 102*a*, 102*b*; and whereby the non-winning player continues tossing the balls 110 towards the opposing target areas 104*a-h* until all the lids 108*a-h* are closed.

In a second aspect, the players include two or more players.

In another aspect, the boxes 102*a*, 102*b* comprise a length of about 48"; a width of about 13"; and a height of about 6¾".

In another aspect, the ball 110 is a 4¼" to 5" sphere.

In another aspect, the target area 104*a-h* comprises four 10" holes.

In another aspect, the lid 108*a-h* is hingedly connected to the box 102*a*, 102*b*.

In another aspect, the boxes 102*a*, 102*b* are positioned 14 feet apart.

One objective of the present invention is to provides entertainment and develop aiming and throwing skills by allowing players to toss balls at target areas 104*a-h* in a number of discrete target areas 104*a-h* with the goal of hitting the target areas 104*a-h* first Those skilled in the art will recognize that tossing games often test the skill of players to aim, throw, or roll, and properly land rings, balls, or other objects in relationship to each other and to other objects or surroundings. Examples of such games include lawn horseshoe, bowling, horseshoes, bocce ball, and croquet. The present multi-target ball toss game 100 is an improvement on these prior games because it can be played indoors or outdoors, does not require large amounts of space, has very few playing parts, does not cause damage to the surface on which the game is played, requires a degree of real strategy in game play, but in which playing competitiveness is largely independent of the age of players.

As referenced in FIG. 1, ball toss game 100 is played with multiple elongated boxes 102*a*, 102*b* disposed in an opposing, spaced-apart relationship. In one embodiment, the boxes 102*a*, 102*b* comprise a length of about 48"; a width of about 13"; and a height of about 6¾". In one embodiment, a set of legs 112*a-d* supporting boxes 102*a*, 102*b*, so as to elevate boxes 102*a*, 102*b*. Though in other embodiments, other dimensions may be used.

In one embodiment, boxes 102*a*, 102*b* are spaced about 14' apart. Though in other embodiments, boxes 102*a*, 102*b* may be positioned at other distances, depending on the indoor or outdoor playing conditions and the ages of the players. The boxes 102*a*, 102*b* are subdivided into a number of discrete target areas 104*a-h*. In one embodiment, target areas 104*a-h* are four 10" holes. Though any number of holes may be used. Nettings 106*a-h* may be used with each target area 104*a-h* to catch the ball 110 as it falls into the target area 104*a-h*.

Figure 2:
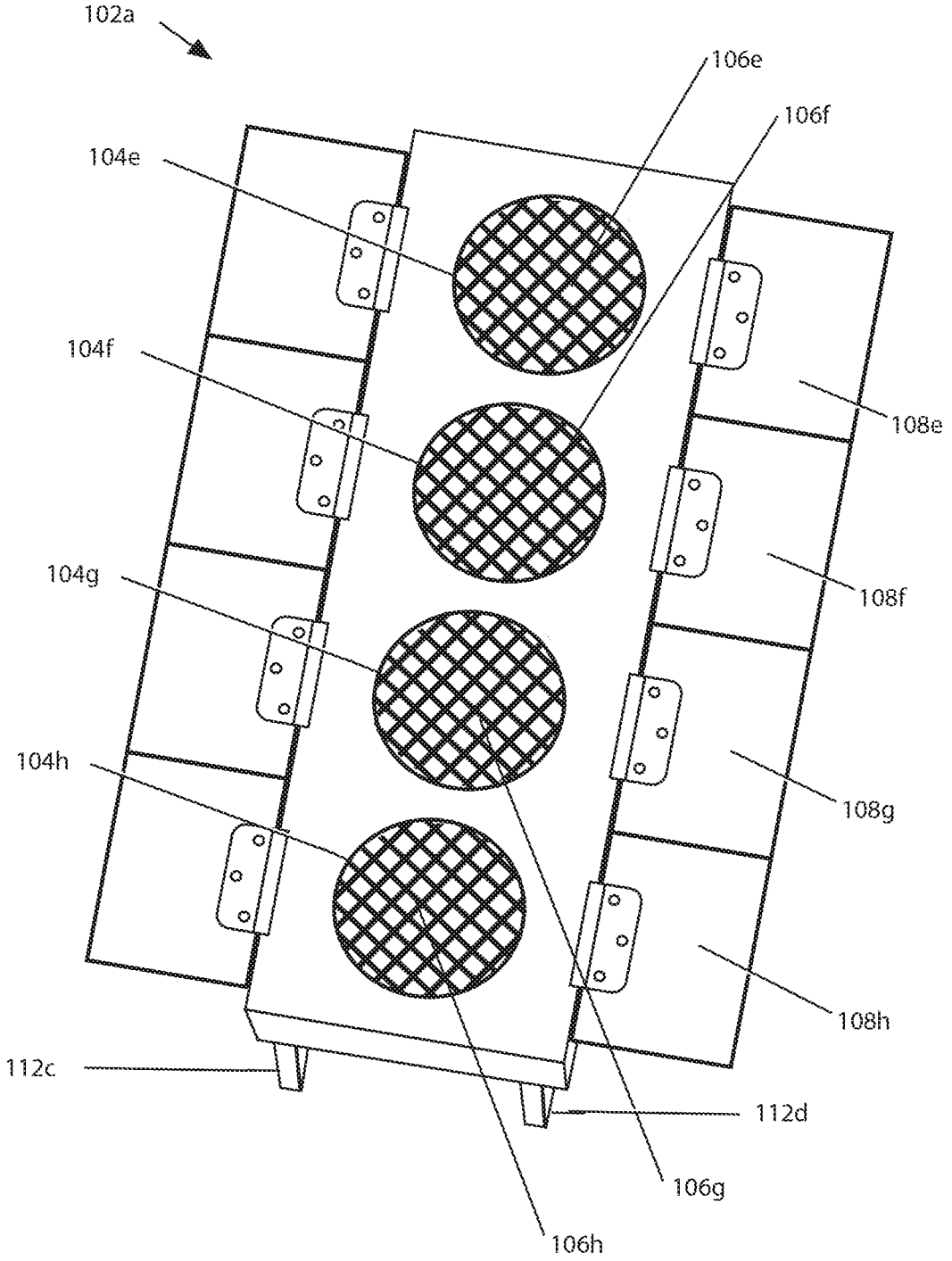
FIG. 2 illustrates a perspective view of an exemplary elongated box having two target areas, in accordance with an embodiment of the present invention.

FIG. 2 illustrates four target areas 104*a-d* with netting 106*a-d* attached thereto for catching the balls 110. A lid 108*a* hingedly covers each target area 104*a*. Though in other embodiments, lid 108*a* may slide over the target area 104*a*, or simply be attached thereto. Lids 108*a-h* easily open and close, depending on whether a ball 110 has fallen into the target area or not. In this manner, tossing the ball 110 into the target areas 104*a* enables closure of a corresponding lid 108*a* over a respective target area 104*a* receiving the ball 110.

In one embodiment, boxes 102*a*, 102*b* are easily constructed through use of basic carpentry skills. Standard 2×4s and plywood panels may be used to construct the boxes 102*a*, 102*b*. In one exemplary construction of the boxes 102*a-b*, two 45" 2×4's are cut; then two 13" 2×4's are cut. The boards are nailed or adhered together to form an elongated frame. Next, a 48"×13" sheet of plywood is cut. The plywood is attached to the frame.

After the boxes 102*a-b* are constructed, the target area is formed by cutting four 10" diameter holes evenly spaced on the top board. Netting 106*a-h* may then be attached to the boards to serve as baskets for catching the balls. A rim may also be constructed through use of ⅜" PVC pipe, so as to form a 10" diameter rim around the target area hole.

After the target area 104*a-h* is constructed, the lids 108*a-h* are constructed. This is accomplished by cutting eight boards at 11½""×6". Hinges are then attached to one edge of the lids 108*a-h*. The hinges are attached to the boards, adjacent to the target areas 104*a-h*. A set of legs 112*a*, 112*b*, 112*c*, 112*d* may also be attached to the bottom of the box 102*a*, 102*b* to elevate the box 102*a*, 102*b*. After construction, there should be four 10" holes on each board with hinged doors that fold over after the ball is tossed into the target area.

Figure 3:
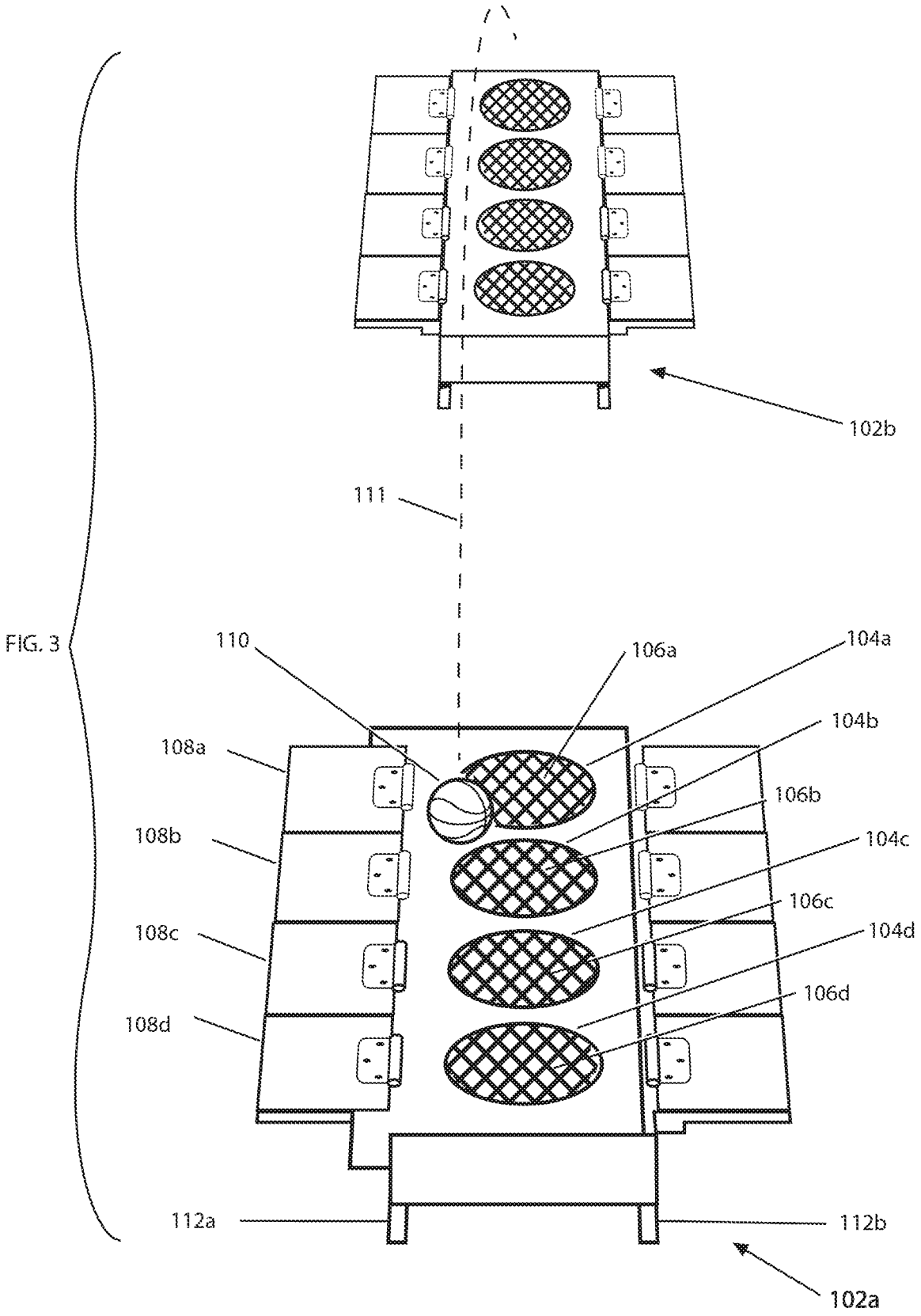
FIG. 3 illustrates a perspective view of two spaced-apart boxes and a ball, in accordance with an embodiment of the present invention.

Turning now to FIG. 3, ball toss game 100 utilizes multiple balls 110 that are sized and dimensioned to fall inside the target areas 104*a-h*. Ball 110 may include a 4¼" to 5" rubber or wooden sphere. However in other embodiments, other objects, beyond balls may be used. Balls 110 may be color-coded to differentiate players and teams.

One embodiment of playing ball toss game 100 utilizes two boxes 102*a-b*. The boxes 102*a-b* may be positioned about 14' apart from each other, measured from the foremost end of the boxes 102*a-b*. Two players stand at opposite ends of their respective boxes 102*a-b*. The players take turns tossing the ball 110 as shown as ball trajectory line 111 (for example) into the opposite box 102*a-b*, attempting to put the ball 110 in the target area 104*a-h*. Redemption tosses with the ball are allowed; whereby the player is allowed to continue tossing balls towards the target areas 104*a-h* until the player misses a target area. Furthermore, after one bounce on the box, the ball 110 can be blocked. However, after the ball 110 makes ground contact the ball 110 is dead, and the opposing player takes a turn to attempt a ball toss.

It is also significant to note that if playing with two teammates; both players get to take a shot. As the target area 104*a* is struck by the ball, the corresponding lid 108*a* closes over the target. The first player who closes the lids on all the target areas 104*a-h* wins the ball toss game 100. In an alternative embodiment, for players over twenty-one years of age, for every shot made against a first player, a shot must be taken by that player. However, this alternative embodiment is recommended for only one game.

In a second embodiment of the multi-target ball toss game, four boxes are utilized. There are two teams of two players each. The teammates stand across from each other at the other board. The objective of each team is to close out the lids on the target areas for both boxes before the other team does. This is accomplished in a relay style form, where the teammates take turns tossing the balls towards the opposite box. The first team to close the lids over both boxes wins. However, if the team closes out the box first, the players from the losing team must throw the ball back to each other until they close out the lids on their box.

Figure 4:
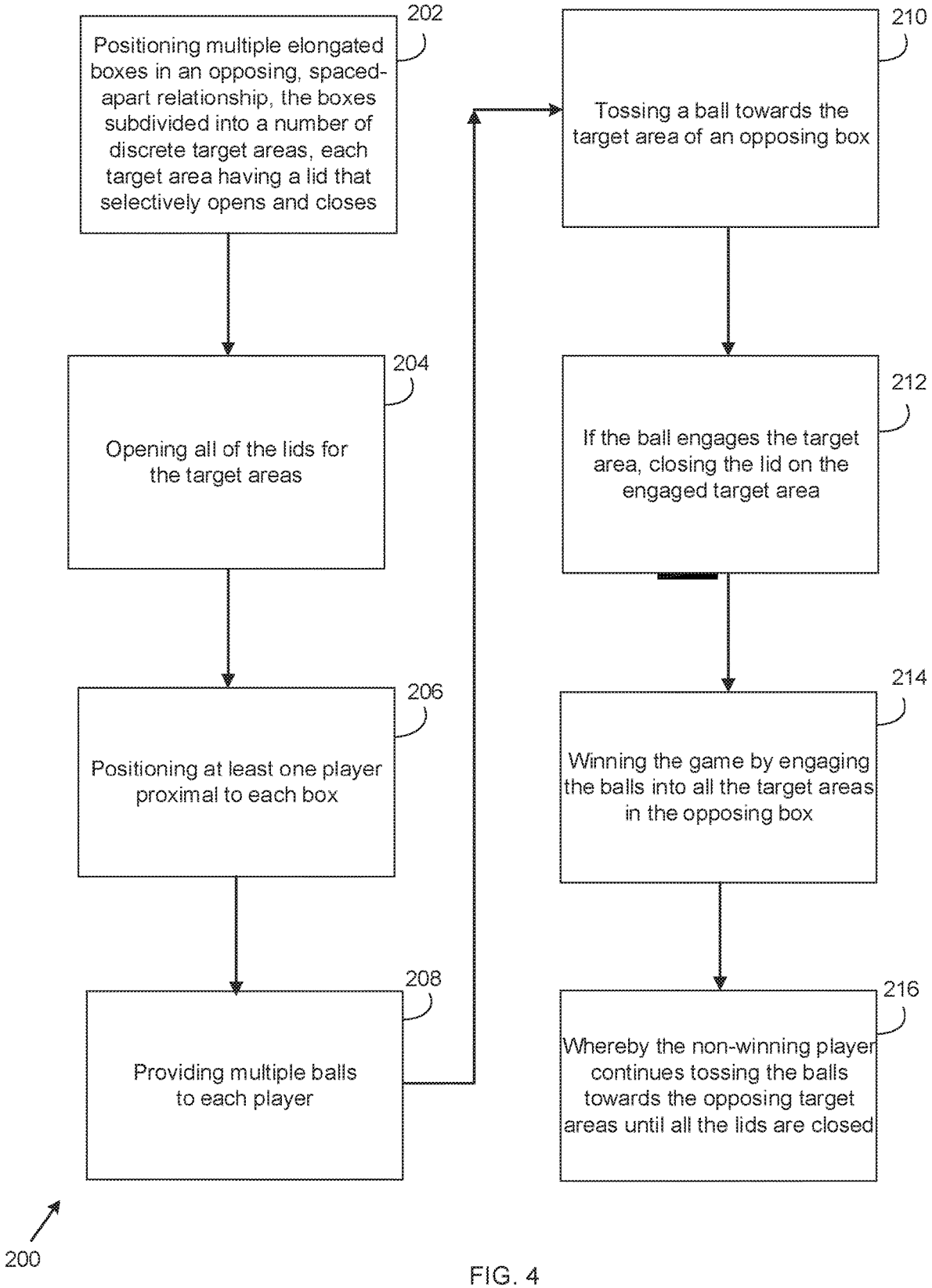
FIG. 4 illustrates a flowchart of an exemplary method for playing a multi-target ball toss game, in accordance with an embodiment of the present invention.

Turning now to FIG. 4, a method 200 for playing a multi-target ball tossing game provides sequential steps for playing and winning ball toss game 100. In some embodiments, method 200 may include an initial Step 202 of positioning multiple elongated boxes in an opposing, spaced-apart relationship, the boxes subdivided into a number of discrete target areas, each target area having a lid that selectively opens and closes. Method 200 may further comprise a Step 204 of opening all of the lids for the target areas. A Step 206 includes positioning at least one player proximal to each box.

In some embodiments, a Step 208 comprises providing multiple balls to each player. A Step 210 includes tossing a ball towards the target area of an opposing box. In some embodiments, a Step 212 may include if the ball engages the target area, closing the lid on the engaged target area. A Step 214 comprises winning the game by engaging the balls into all the target areas in the opposing box. A final Step 216 includes whereby the non-winning player continues tossing the balls towards the opposing target areas until all the lids are closed.

Although the process-flow diagrams show a specific order of executing the process steps, the order of executing the steps may be changed relative to the order shown in certain embodiments. Also, two or more blocks shown in succession may be executed concurrently or with partial concurrence in some embodiments. Certain steps may also be omitted from the process-flow diagrams for the sake of brevity. In some embodiments, some or all the process steps shown in the process-flow diagrams can be combined into a single process.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What I claim is:

1. A multi-target ball tossing game, the game comprising:

multiple elongated flat target surfaces in an opposing, spaced-apart relationship, the flat target surfaces subdivided into a number of discrete target areas, each target area having a hinged lid that selectively opens and closes;

wherein each hinged lid is fastened to the target at a longitudinal side of the flat target surface;

a set of legs supporting the flat target surface;

multiple nettings attached to the target areas; and multiple balls sized and dimensioned to fall inside the target areas, whereby the flat target surface are disposed in opposing, spaced-apart relationship, whereby tossing the balls into the target areas enables closure of a lid over a respective target area receiving the ball according to a procedure for playing the game.

2. The game of claim 1, wherein the flat target surfaces comprise a length of about 48"; a width of about 13"; and a height of about 6½".

3. The game of claim 1, wherein the ball is a 4¼ to 5" sphere.

4. The game of claim 1, wherein a set of hinges and a set of lids are positioned on both longitudinal sides of the flat target surface and wherein each lid is sized and shaped to cover approximately half of the target area adjacent to the lid when the lid is closed such that a target are is completed covered when both lids corresponding to a target area are closed.

5. The game of claim 1, wherein each lid is flat.

6. The game of claim 1, wherein the game includes a set of 4 boards.

7. The game of claim 1, wherein each flat target surface includes 4 target areas.

8. The game of claim 1, wherein each hinged lid is rectangular.

9. The game of claim 1, wherein closure of each hinged lid for a corresponding target area is configured to cover an entire rectangular section of the flat target surface surrounding the target area.

10. A multi-target projectile tossing game, the game comprising:

multiple elongated flat target surfaces in an opposing, spaced-apart relationship, the flat target surfaces subdivided into a number of discrete target areas, each target area having a hinged lid that selectively opens and closes;

wherein each hinged lid is fastened to the flat target surface at a longitudinal side of the flat target surface;

a set of legs supporting the flat target surface; and multiple projectiles sized and dimensioned to fall inside the target areas, whereby the flat target surfaces are disposed in opposing, spaced-apart relationship, whereby tossing the projectiles into the target areas enables closure of a lid over a respective target area receiving the projectile according to a procedure of the game.

11. The game of claim 10, wherein a netting is attached to each target area.

12. The game of claim 10, wherein a set of hinges and a set of lids are positioned on both longitudinal sides of the flat target surface and wherein each lid is sized and shaped to cover approximately half of the target area adjacent to the lid when the lid is closed such that a target are is completed covered when both lids corresponding to a target area are closed.

13. The game of claim 10, wherein the lids are flat.

14. The game of claim 10, wherein the game includes 4 boards.

15. The game of claim 10, wherein each flat target surface includes 4 target areas.

* * * * *